US005328354A

United States Patent [19]

McGrath et al.

[11] Patent Number: 5,328,354

[45] Date of Patent: Jul. 12, 1994

[54] INCINERATOR WITH AUXILIARY GAS EVACUATION SYSTEM

[75] Inventors: Kevin D. McGrath, Lehighton; Sivaramasubramanian Ramachandran, Warrington, Pa.

[73] Assignee: MG Industries, Malvern, Pa.

[21] Appl. No.: 35,654

[22] Filed: Mar. 23, 1993

[51] Int. Cl.[5] ..... F23D 14/00

[52] U.S. Cl. ..... 431/5; 110/212; 110/214; 110/215; 431/29; 431/30; 422/168; 422/110

[58] Field of Search ..... 110/211, 212, 214, 215, 110/160, 162, 185, 188; 431/5, 29, 202, 30; 422/168, 110

[56] References Cited

U.S. PATENT DOCUMENTS 4,661,056 4/1987 Vickery et al. .

4,973,451 11/1990 Vickery ..... 431/5 X

OTHER PUBLICATIONS

Exair Corporation publication, entitled "Exair-Amplifiers" pp. 27-32 (no date).

*Primary Examiner*—Edward G. Favors

*Attorney, Agent, or Firm*—William H. Eilberg

[57] ABSTRACT

An incinerator for combustible or thermally-decomposable gases includes a device which insures that gas continues to flow through the incinerator in the event of failure of the scrubber fan connected to the outlet of the incinerator. When the scrubber fan fails, a solenoid-operated valve opens, and compressed gas from a tank flows through the valve into the main conduit of the incinerator. The compressed gas enters the main conduit through an air flow amplifier installed within the main conduit. The air flow amplifier magnifies the effect of the compressed gas, and creates a region of negative pressure which assures that toxic or hazardous gases do not remain in the incinerator, but instead continue to flow toward the scrubber fan, even after the fan has failed.

10 Claims, 2 Drawing Sheets

INCINERATOR WITH AUXILIARY GAS EVACUATION SYSTEM

BACKGROUND OF THE INVENTION

This invention relates to the field of incinerators. The invention is especially intended for incinerating hazardous gases, such as silane, which are vented from semiconductor manufacturing equipment.

Silane gas is a byproduct of the semiconductor manufacturing process. In the latter process, silane gas is generally made to flow, at or near atmospheric pressure, over silicon wafers for reaction with the silicon. Silane leaving the region of the wafers constitutes a safety hazard because it can ignite spontaneously upon contact with air.

U.S. Pat. No. 4,661,056 discloses an incinerator specifically intended for use in burning silane gas or other gases. This specification hereby incorporates by reference the disclosure of the latter patent. The incinerator described in the latter patent has a first pipe and a second pipe, the pipes being mutually perpendicular, and being welded or otherwise bonded to each other. A central section of the exterior wall of the first pipe is open to the second pipe, so that the two pipes are in fluid communication with each other. The first pipe also has an open end, into which air (or some other gas which supports combustion) flows. Silane gas (or some other gas which is to be combusted) enters the system through the second pipe.

In order to assure uniformity of the semiconductor manufacturing process, the silane gas is conveyed through the semiconductor manufacturing apparatus at low pressure. Thus, the silane gas entering the second pipe is still at low pressure. The air entering through the first pipe strikes a side wall of the second pipe, and establishes a turbulent, centrifugal swirling action which causes the air to mix with the silane, and to break oxide bubbles which may have formed around the silane. The swirling action promotes complete combustion of the silane gas. The air also provides a cooling medium for the gaseous products of combustion.

A spark plug provides additional control over the incineration process. The incinerated gases pass through the remainder of the first pipe, and enter a scrubber. A fan draws the gases out of the first pipe and towards the scrubber.

The apparatus described above has the following potential safety problem. If the scrubber fan fails, the air movement through the incinerator is reduced, and there is a risk that the toxic gases still in the incinerator may escape through its open end. One possible solution to this problem is to provide backup power for the scrubber fan, and to connect the process reactor to the fan, so that the reactor stops if the fan fails.

Clearly, the latter solution does not account for the gases which are still located in the process line. To some extent, the fan will continue to draw gases out of the incinerator even after power is lost, because the fan will continue to operate for a short time due to inertia. The effectiveness of the fan after loss of power depends on various factors such as fan capacity, the size and length of the main duct, the number of lines entering the duct, and the length of the conduit between the process reactor and the incinerator. Reliance on the inertia of the fan is obviously not a satisfactory solution, as there is no assurance that the decelerating fan will operate long enough to convey all remaining toxic gases to the scrubber.

The present invention provides an incinerator with an improved auxiliary evacuation system for removing toxic gases from the incinerator in the event of failure of the scrubber fan.

SUMMARY OF THE INVENTION

In the present invention, a source of compressed gas is directed into the main pipe of an incinerator in the event of failure of the scrubber fan. The compressed gas is preferably injected into the main pipe through an annular chamber formed in the pipe. The annular chamber forms part of an air flow amplifier which uses the compressed gas to boost the flow of air through the system. When the scrubber fan is operating, a signal from the fan holds a normally-closed solenoid valve in its closed position, preventing compressed gas from entering the main pipe of the incinerator. When the scrubber fan fails, the valve switches to the open position, which allows compressed gas to flow from a suitable storage tank, through the valve, and into the main pipe of the incinerator. The compressed gas creates a negative pressure region in the main pipe, and this negative pressure region draws toxic gases in the incinerator through the incinerator and towards the main duct.

The present invention is especially suitable for incineration of silane gas, such as is used in the manufacture of semiconductors, but is also useful for handling other combustible or thermally-decomposable gases.

The present invention therefore has the primary object of providing an incinerator for toxic gases such as silane.

The invention has the further object of improving the safety of incinerators for toxic gases such as silane.

The invention has the further object of providing a means for conveying toxic gases through an incinerator in the event of failure of the fan which normally draws such gases through the system.

The invention has the further object of improving the safety of the semiconductor manufacturing process, by providing a more reliable means of disposal of toxic gases used during that process.

The person skilled in the art will recognize other objects and advantages of the invention, from a reading of the following brief description of the drawings, the detailed description of the invention, and the appended claims.

DETAILED DESCRIPTION OF THE INVENTION

Figure 1:
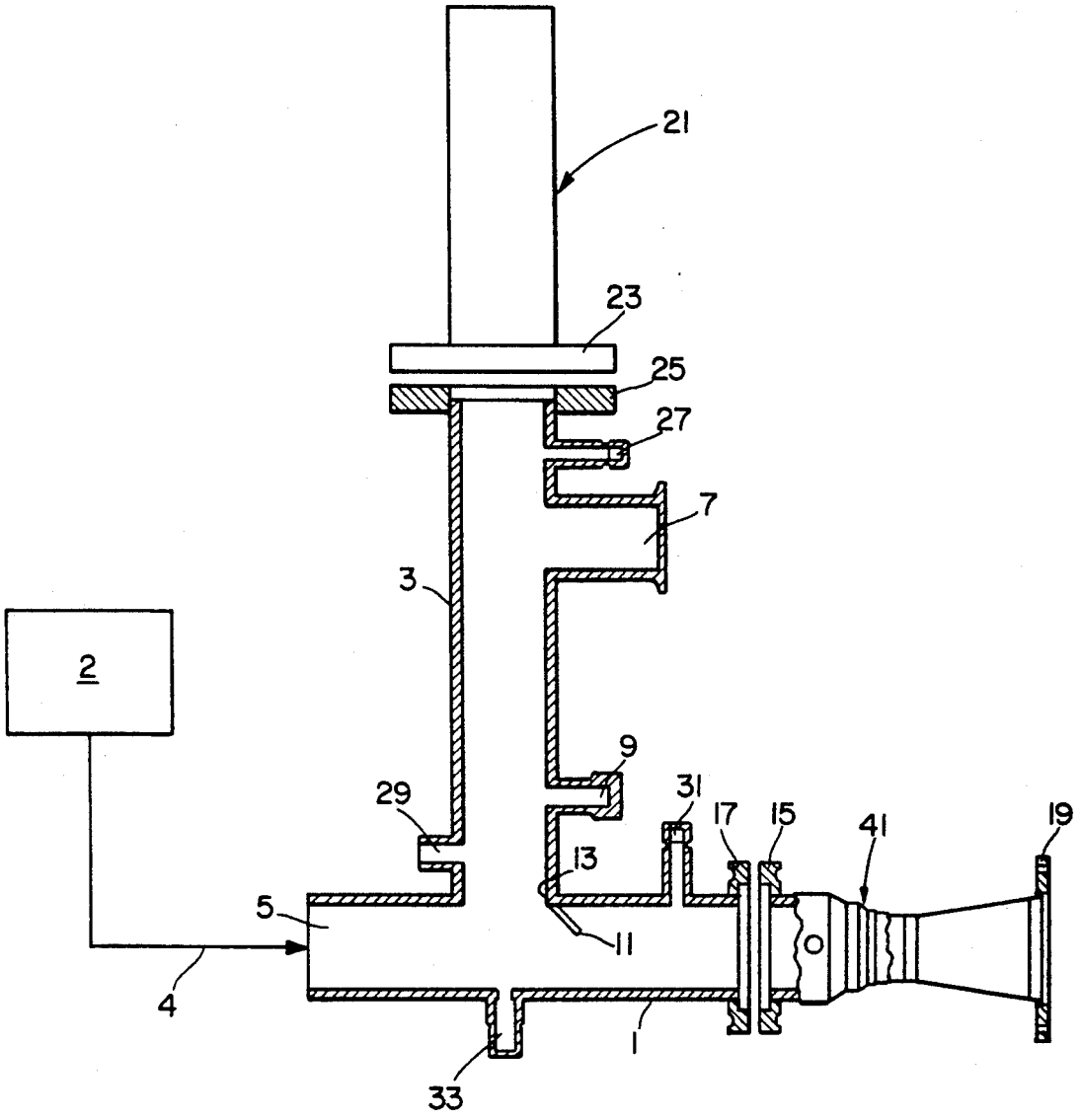
FIG. 1 provides a side view, partly in cross-section, showing the incinerator of the present invention.

FIG. 1 shows a gas incinerator made according to the present invention. The incinerator includes first pipe 1 and second pipe 3. The second pipe is attached to the first pipe, at a substantially right angle thereto, and is open to the first pipe. Note also that the second pipe is attached at a central region of the first pipe, so as to form a "T" connection. While gas can flow between the first and second pipes, outside air does not enter the system at the junction of the two pipes.

The first pipe has an open end 5, through which ambient air enters the first pipe. The apparatus includes a means, symbolically illustrated by block 2, for turbulently conveying the air into the first pipe, through conduit 4. Gases to be incinerated enter the system through pipe 3. The gas to be incinerated originates in a reactor (not shown), and is conveyed to pipe 3 through conduit 7. Igniter port 9 provides access for a spark plug or other ignition means. One or more additional igniter ports can be disposed around the periphery of second pipe 3. If the gas is pyrophoric (as is true in the case of silane gas), the gas will normally ignite in the presence of air, but the use of one or more igniters improves the reliability of the system. Baffle 11 directs the flame produced by combustion away from the inside wall of first pipe 1. The baffle may also play a role in creating the turbulent air flow necessary to burn the gas properly. It is believed that some of the air flowing through first pipe 1 strikes point 13 of the side wall of second pipe 3, and that this effect helps to create desired turbulent air flow, as described in the above-cited patent.

An air flow amplifier, designated generally by reference numeral 41, is connected to the outlet end of first pipe 1, as shown in FIG. 1. The structure of the air flow amplifier will be discussed in more detail below. In the arrangement shown in FIG. 1, the air flow amplifier includes flange 15, which is attachable to a similar flange 17 formed at the outlet end of first pipe 1. Another flange 19, located at the outlet end of the air flow amplifier, provides means for connection of the air flow amplifier to another pipe. The flanges are shown spaced from each other in FIG. 1, for clarity of illustration, but it is understood that in operation, the flanges are firmly attached to each other, so that the air flow amplifier comprises a continuation of the first pipe 1.

The incinerator of FIG. 1 includes a cleaning device, indicated generally by reference numeral 21. The cleaning device has a flange 23 which attaches to flange 25 which forms part of second pipe 3. The cleaning device preferably includes a brush (not shown) which is periodically extended into the second pipe 3, and which can be rotated to clean the inside surface of the second pipe. The brush is normally retracted within the housing of cleaner 21, but a portion of the brush may still project into the second pipe 3.

The apparatus also includes nitrogen inlet port 27, through which one introduces nitrogen which tends to keep the incoming gases away from the cleaning brush, to prevent contamination of the brush. The nitrogen acts as a barrier which prevents the gases to be incinerated from traveling upward, as shown in FIG. 1.

The apparatus also includes various sensors used for diagnostic purposes. Thermocouple ports 29 and 31 provide means for introducing temperature sensors into the interior of the pipes. Port 29 makes it possible to monitor the temperature in the second pipe, near the point of ignition, and port 31 enables monitoring of the temperature in the first pipe, near the air flow amplifier. Ultraviolet sensor 33 detects the presence or absence of a flame, so that the operator of the apparatus will know whether combustion is occurring.

While the arrangement shown in FIG. 1 represents the preferred embodiment, various elements can be changed, within the scope of the invention. The cleaner 21 could be omitted entirely. If one omits the cleaner, one could also omit the nitrogen inlet. The arrangement of sensors can be changed considerably; sensors can be omitted or added, or moved. If one omits the cleaner, one could direct the gas to be incinerated into the second pipe from the top end shown in FIG. 1.

Figure 2:
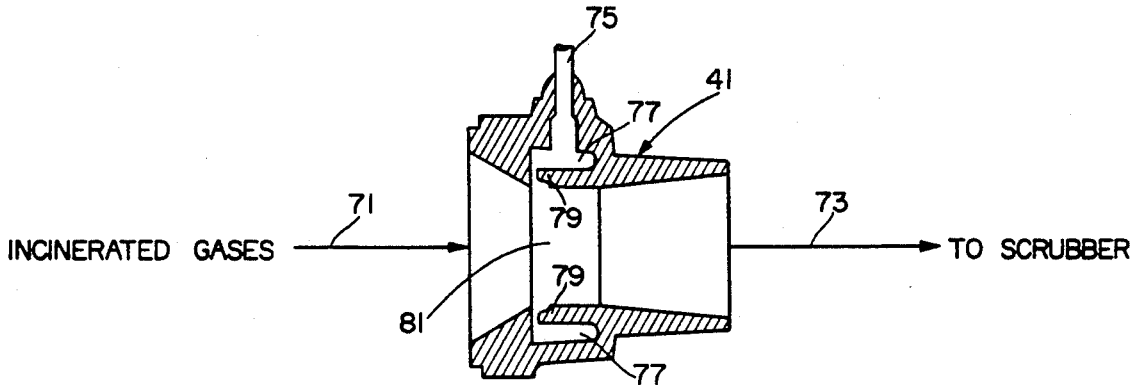
FIG. 2 shows a cross-sectional view of the air flow amplifier used in the present invention.

FIG. 2 provides a more detailed diagram of the air flow amplifier used in the present invention. The air flow amplifier is a commercially available unit which can be obtained from Exair Corporation, of Cincinnati, Ohio. The gases to be incinerated enter the air flow amplifier through conduit 71 and exit the amplifier by conduit 73. Compressed gas is introduced at compressed gas inlet 75. The compressed gas flows into annular chamber 77. The annular chamber has a constricted opening, formed by member 79. The constricted opening allows gas to flow from the annular chamber into the main conduit. Due to the pressure of the gas and the constricted opening through which it flows, and due to the shape of member 79, the gas flows at high velocity, and generally adheres to the edges of member 79 while it flows in the direction of outlet conduit 73. The net effect is that the compressed gas creates a low pressure area in central region 81, which induces a high volume flow of air into and through the air flow amplifier. The latter effect is known in the field of fluidics as the "coanda effect". A relatively small amount of compressed air causes a much larger amount of air to be pulled through the amplifier and towards the outlet conduit.

In one example, when one introduces compressed gas into the air flow amplifier at the rate of one cubic foot per minute (CFM), the amplifier could induce a flow of as much as 15–20 CFM through it.

Figure 3:
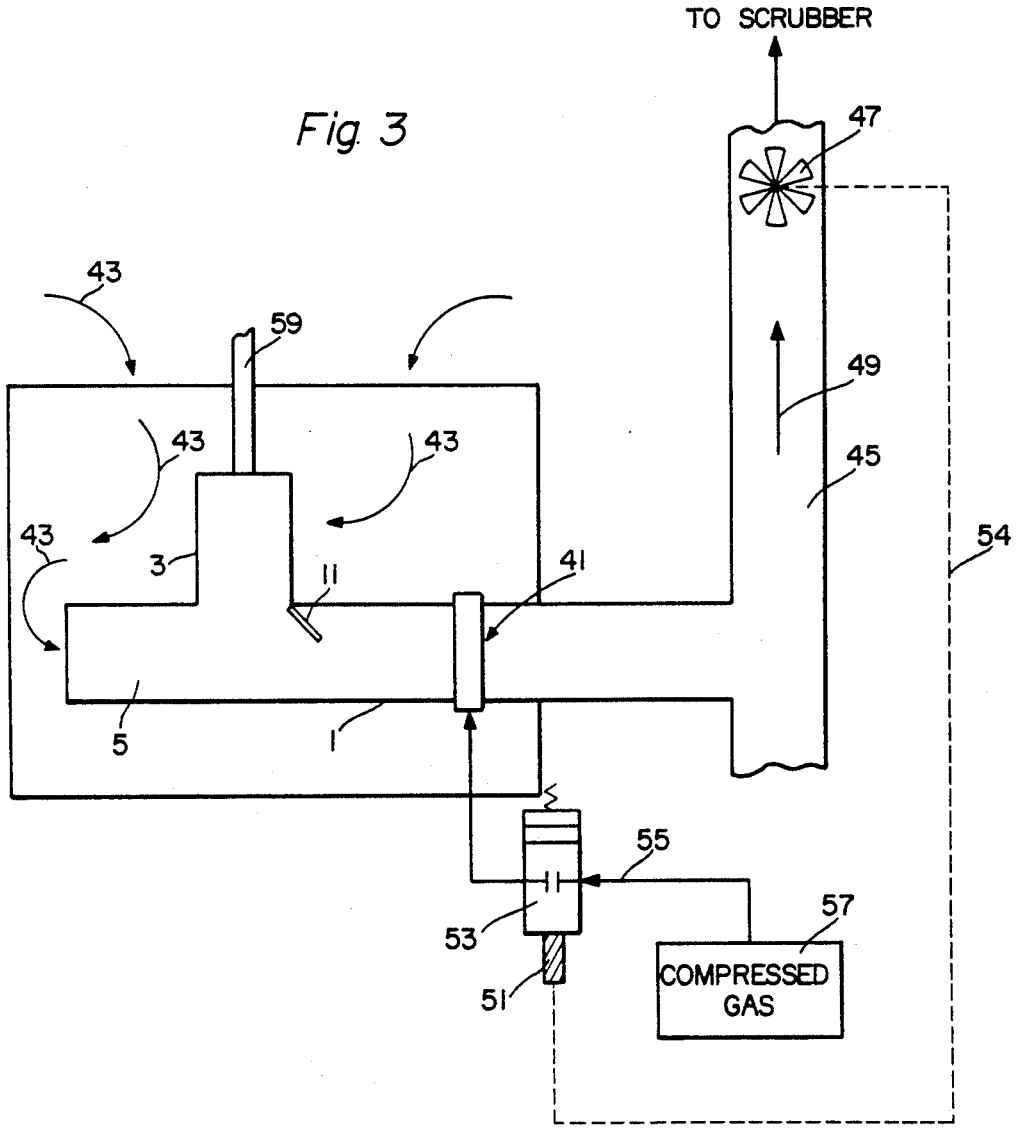
FIG. 3 provides a schematic diagram of the incinerator of the present invention, and showing the means for introducing compressed gas into the main duct of the incinerator.

FIG. 3 shows the invention in schematic form. Components which are the same as those shown in FIG. 1 are indicated by similar reference numerals. Arrows 43 represent the flow of ambient air into open end 5 of first pipe 1. The gas to be incinerated enters second pipe 3 through conduit 59 which is equivalent to conduit 7 of FIG. 1. The diagram of FIG. 3 also shows baffle 11 which directs the flame away from the walls of first pipe 1. FIG. 3 explicitly shows that first pipe 1 is connected to a main duct 45. The main duct leads to a scrubber, one component of which is scrubber fan 47. The scrubber fan draws gas through the system, so that the gas flows in the direction indicated by arrow 49.

The scrubber fan is operatively connected to solenoid 51 of solenoid valve 53. The connection between the scrubber fan and the solenoid valve is represented by dotted line 54. The solenoid valve is connected within gas flow line 55 leading from compressed gas storage tank 57 to air flow amplifier 41. The air flow amplifier is shown only schematically in FIG. 3; it is understood that the physical structure of the air flow amplifier is as shown in FIGS. 1 and 2.

Tank 57 holds nitrogen, or some other inert or relatively inert compressed dry gas. The solenoid valve is shown in its normal, shut-off position. In this position, compressed gas from tank 57 does not reach air flow amplifier 41. As long as scrubber fan 47 continues to operate, it holds the solenoid in the illustrated shut-off position.

When the scrubber fan loses power, the solenoid is de-energized, and a spring in the valve mechanism causes the valve to shift to its fully open position. Compressed gas then flows from tank 57 to air flow amplifier 41. The compressed gas flowing through the air flow amplifier induces a small negative static pressure at the inlet end of the amplifier (the outlet end of the first pipe), and prevents residual gases in the first and second pipe from escaping through the open end 5 of the first pipe. Moreover, residual gases in first pipe 1 tend to be drawn out of the incinerator, towards the scrubber, due to the action of the air flow amplifier.

It is also possible to use the compressed gas and air flow amplifier as the primary means of propelling gases through the system, instead of relying on the scrubber fan. A major advantage of the combination of the compressed gas source and air flow amplifier is that they operate without any mechanical moving parts, and without the need for electric power.

Although the invention has been described with emphasis on the incineration of silane used in the manufacture of semiconductors, the invention can be used to incinerate other gases, both pyrophoric and nonpyrophoric. In general, one can use the present invention to eliminate virtually any combustible or thermally-decomposable gas.

Another aspect of the invention relates to the use of fuel by the incinerator. In the incinerators used in the prior art, a fixed amount of fuel flows into the incinerator at all times. However, the substance being incinerated (such as silane or some other gas) is not necessarily consumed at a uniform rate, in the underlying process. Therefore, one can minimize the consumption of fuel by the incinerator by regulating the flow of such fuel according to the process step being currently operated. In other words, one coordinates the flow of fuel to the incinerator with the status of the underlying process. For example, when the process is in a "standby" mode, and is not yet operating, only a small flow of fuel to the incinerator is necessary. When the process is operating at its maximum rate, the flow of fuel to the incinerator can be correspondingly increased to a maximum level. The result is a substantial saving of fuel.

While the invention has been described with respect to particular embodiments, various modifications can be made, within the scope of the invention. Such modifications as will be apparent to those skilled in the art, should be considered within the spirit and scope of the following claims.

What is claimed is:

1. In an incinerator for combustible or thermally-decomposable gas, the incinerator comprising a first pipe having open entrance and exit portions and an inlet opening disposed between the entrance and exit portions, a second pipe having first and second ends, the first end being fixed about said inlet to provide fluid communication between the pipes, the second end being substantially closed to an outside environment, ignition means disposed within the second pipe, means for conveying at least one combustible gas into the second pipe, and means for turbulently conveying a stream of a gas capable of supporting combustion into the entrance end of the first pipe, and for centrifugally swirling said turbulently flowing gas into and out of the second pipe and for discharging said turbulently flowing gas through the exit end of the first pipe, the exit end of the first pipe being connected to a conduit having means for drawing gas through the first pipe, the improvement comprising a source of compressed gas, and means for introducing compressed gas from the source into said first pipe, wherein the compressed gas comprises means for propelling gases through the first pipe in the event said gas-drawing means becomes inoperative.

2. The improvement of claim 1, wherein the gas-drawing means includes a scrubber fan located in a duct which is in fluid communication with the first pipe.

3. The improvement of claim 2, wherein the scrubber fan is operatively connected to a valve, the valve providing a fluid flow path between a source of compressed gas and the introducing means.

4. The improvement of claim 3, wherein the introducing means comprises an air flow amplifier, the air flow amplifier having means defining an annular chamber into which the compressed gas flows, the annular chamber having an opening which allows compressed gas to flow from the chamber into the first pipe.

5. In an apparatus for incinerating combustible or thermally-decomposable gas, the apparatus including a first pipe member having an open inlet end and an outlet end, the first pipe member fluidly communicating with a second pipe member which has an ignition means disposed therein, and means for turbulently conveying gas from the first pipe member into the second pipe member and back to the first pipe member, and for directing said gas to the outlet end of the first pipe member, the outlet end of the first pipe member being connected to an outlet conduit having a fan disposed therein, the fan comprising means for drawing gases through the first pipe member, the improvement comprising a source of compressed gas, and conduit means for conveying compressed gas from the source into an interior region of said first pipe member, wherein the compressed gas comprises means for propelling gases through the first pipe member in the event said fan becomes inoperative.

6. The improvement of claim 5, wherein the compressed gas is introduced into the first pipe member through a generally annular chamber formed within the first pipe member.

7. The improvement of claim 5, wherein the scrubber fan is operatively connected to a valve located within said gas-conveying conduit means, wherein stoppage of the fan causes the valve to open and to allow the compressed gas to flow into the first pipe member.

8. An incinerator for combustible or thermally-decomposable gas, comprising a first pipe having an open end for allowing a combustion-supporting gas into the first pipe, a second pipe in fluid communication with the first pipe for admitting the combustible or thermally-decomposable gas into the first pipe, means for turbulently mixing the combustion-supporting gas with the combustible or thermally-decomposable gas, the first pipe being connected to an air flow amplifier, the air flow amplifier having an outlet end connected to a duct, the duct having a fan disposed within the duct for drawing gases out of the first pipe, the air flow amplifier being driven by a source of compressed gas, and means for directing the compressed gas into the air flow amplifier in the event of failure of the fan.

9. The incinerator of claim 8, wherein the directing means includes a normally-closed valve, wherein the source of compressed gas comprises a tank, and wherein the valve is connected between the tank and the air flow amplifier, and wherein the valve includes means for changing a position of the valve according to whether the fan is operating.

10. A method of removing toxic gases from an incinerator in the event of failure of a scrubber fan, the scrubber fan being provided to draw gases out of the incinerator ator and into an outlet duct, the method comprising the steps of:

a) detecting an interruption of electric power to the scrubber fan, b) switching a position of a valve according upon detection of interruption of power to the scrubber fan, the valve being connected between a source of compressed gas and a main pipe of the incinerator, and c) allowing the compressed gas to flow into the main pipe, through an annular chamber, so as to cause gases in the incinerator to be drawn into the outlet duct even after the scrubber fan is no longer operating.

* * * * *